US009607535B2

(12) United States Patent
Lee et al.

(10) Patent No.: US 9,607,535 B2
(45) Date of Patent: Mar. 28, 2017

(54) DISPLAY DEVICE AND METHOD FOR DRIVING THE SAME

(71) Applicant: SAMSUNG DISPLAY CO., LTD., Yongin-si, Gyeonggi-do (KR)

(72) Inventors: Jae-Hoon Lee, Seoul (KR); Jung-Tak Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 73 days.

(21) Appl. No.: 14/592,811

(22) Filed: Jan. 8, 2015

(65) Prior Publication Data

US 2015/0269881 A1 Sep. 24, 2015

(30) Foreign Application Priority Data

Mar. 18, 2014 (KR) ..... 10-2014-0031736

(51) Int. Cl.

| | |
|---|---|
| ***G09G 3/30*** | (2006.01) |
| ***G09G 3/00*** | (2006.01) |
| ***G09G 3/3208*** | (2016.01) |
| ***G09G 3/20*** | (2006.01) |
| ***G09G 3/3233*** | (2016.01) |

(52) U.S. Cl.

CPC ..... *G09G 3/003* (2013.01); *G09G 3/2022* (2013.01); *G09G 3/3208* (2013.01); *G09G 3/3233* (2013.01); *G09G 2300/0413* (2013.01); *G09G 2310/02* (2013.01)

(58) Field of Classification Search

None

See application file for complete search history.

(56) References Cited

U.S. PATENT DOCUMENTS 5,475,448 A * 12/1995 Saegusa ..... G09G 3/2037 345/214
6,646,625 B1 * 11/2003 Shigeta ..... G09G 3/2022 315/169.4
7,495,648 B2 * 2/2009 Kang ..... G09G 3/20 345/100
7,777,698 B2 * 8/2010 Takahara ..... G09G 3/006 345/204
7,932,885 B2 * 4/2011 Murade ..... G09G 3/3688 345/100

(Continued)

FOREIGN PATENT DOCUMENTS

| | | |
|---|---|---|
| KR | 10-2012-0010774 | 2/2012 |
| KR | 10-2012-0048278 | 5/2012 |
| KR | 10-2012-0133432 | 12/2012 |

*Primary Examiner* — Dismery Mercedes

(74) *Attorney, Agent, or Firm* — Lewis Roca Rothgerber Christie LLP

(57) ABSTRACT

In a method of driving an organic light emitting display device, the organic light emitting display device includes: a plurality of data lines; a plurality of scan lines; and a plurality of pixels coupled to the data lines and the scan lines, the method includes: applying dummy-data signals and pre-data signals to the pixels from respective ones of the scan lines during a non-emission period; and non-sequentially applying scan signals and data signals to the pixels from the respective ones of the scan lines during an emission period, wherein the data signals include data information corresponding to respective subfields in a unit time.

15 Claims, 9 Drawing Sheets

(56) References Cited

U.S. PATENT DOCUMENTS

| | | | | |
|---|---|---|---|---|
| 7,944,458 | B2 * | 5/2011 | Kwon | G09G 3/2011 345/690 |
| 8,059,140 | B2 * | 11/2011 | Kwon | G09G 3/2011 345/690 |
| 8,963,814 | B2 * | 2/2015 | Kim | G09G 3/3233 345/207 |
| 2003/0112205 | A1 * | 6/2003 | Yamada | G09G 3/3233 345/32 |
| 2003/0197667 | A1 | 10/2003 | Numao | |
| 2005/0254702 | A1 * | 11/2005 | Era | H04N 13/026 382/154 |
| 2010/0259512 | A1 * | 10/2010 | Lin | G09G 3/3677 345/204 |
| 2011/0069061 | A1 * | 3/2011 | Nakamura | G09G 3/3225 345/214 |
| 2011/0221972 | A1 * | 9/2011 | Kawabata | G09G 3/3666 348/731 |
| 2012/0113161 | A1 * | 5/2012 | Hong | G09G 3/003 345/690 |
| 2012/0139901 | A1 * | 6/2012 | Hwang | H04N 13/0497 345/419 |
| 2012/0154352 | A1 * | 6/2012 | Yamashita | G09G 3/3233 345/207 |
| 2012/0169678 | A1 * | 7/2012 | Shin | G09G 3/20 345/204 |
| 2012/0306858 | A1 | 12/2012 | Song | |
| 2014/0063023 | A1 * | 3/2014 | Baek | G09G 1/00 345/501 |
| 2014/0333604 | A1 * | 11/2014 | Omoto | G09G 3/3233 345/212 |
| 2014/0361960 | A1 * | 12/2014 | Yamauchi | G09G 3/3233 345/76 |

* cited by examiner

DISPLAY DEVICE AND METHOD FOR DRIVING THE SAME

CROSS-REFERENCE TO RELATED APPLICATION

This application claims priority to and the benefit of Korean Patent Application No. 10-2014-0031736, filed on Mar. 18, 2014, with the Korean Intellectual Property Office, the disclosure of which is incorporated herein in its entirety by reference.

BACKGROUND

1. Field

Aspects of embodiments of the present invention relate to an organic light emitting display device and a driving method thereof.

2. Description of the Related Art

In general, display devices include a plurality of pixels provided in an area defined by a black matrix or a pixel defining layer. Different categories of display devices include liquid crystal displays (LCDs), plasma display panels (PDPs), organic light emitting displays (OLEDs), and the like.

OLEDs use organic light emitting diodes capable of emitting light by recombining electrons and holes in order to display an image, and generally may have characteristics such as relatively lower power consumption and relatively shorter response time compared to other categories of display devices.

As examples of methods for driving the OLED, there are a sequential driving method of receiving data signals in response to scan signals sequentially applied to the plurality of pixels and emitting lights from the pixels in order of data signal arrival, and a digital driving method of receiving the data signals for one frame and emitting light from all the pixels concurrently (e.g., simultaneously).

The digital driving method expresses gray-scale by using subfields and has been pursued as a potentially viable driving method for large-sized organic electroluminescence display devices. However, it is difficult to have each pixel of the large-sized organic electroluminescent display device charged to a desired voltage, and thus pixel uniformity may become deteriorated.

It is to be understood that this background section is intended to provide useful background for understanding the technology of the present invention. As such, the information disclosed in this background section may include ideas, concepts, descriptions, or recognitions that were not part of what was known or appreciated by those skilled in the pertinent art prior to a corresponding effective filing date of subject matter disclosed herein.

SUMMARY

Aspects of embodiments of the present invention relate to an organic light emitting display device capable of providing uniform image quality by employing a digital driving method.

Aspects of embodiments of the present invention include a large-sized high-resolution display device, and a driving method thereof, that is relatively improved in luminance uniformity compared to other large-sized display devices by employing a high-speed driving method for a large-sized panel.

According to aspects of embodiments of the present invention, in a method of driving an organic light emitting display device, the organic light emitting display device includes: a plurality of data lines; a plurality of scan lines; and a plurality of pixels coupled to the data lines and the scan lines, the method includes: applying dummy-data signals and pre-data signals to the pixels from respective ones of the scan lines during a non-emission period; and non-sequentially applying scan signals and data signals to the pixels from the respective ones of the scan lines during an emission period, wherein the data signals include data information corresponding to respective subfields in a unit time.

The respective subfields in the unit time may be different from each other.

The pre-data signals may be the same as subfield data at an end of the emission period.

The pre-data signals may assign parts of weights at a beginning of the emission period to satisfy a weight of a corresponding subfield in one frame.

The subfield data subsequent to the pre-data signals may be provided to the pixels before frame-starting subfield data are provided during the emission period.

The dummy-data signals may each be the same as subfield data of a different one of the scan lines started at a selection time before a subfield corresponding to one of the pre-data signals during the emission period.

The dummy-data signals may each be applied at least one selection time before the one of the pre-data signals is applied.

The scan signals may not be applied to the pixels of the scan lines when the dummy-data signals are applied.

The scan signals may be sequentially applied during the non-emission period.

The scan signals may be applied to the pixels when the pre-data signals are provided.

According to aspects of embodiments of the present invention, in a method of driving an organic light emitting display device, the organic light emitting display device including: a plurality of data lines; a plurality of scan lines; and a plurality of pixels coupled to the data lines and the scan lines, the method including: receiving first image information; receiving second image information different from the first image information; applying first dummy-data signals and first pre-data signals based on the first image information to the pixels from respective ones of the scan lines during a first non-emission period; non-sequentially applying first scan signals and first data signals based on the first image information to the pixels from the respective ones of the scan lines during a first emission period; applying second dummy-data signals and second pre-data signals based on the second image information to the pixels from the respective ones of the scan lines during a second non-emission period; and non-sequentially applying second scan signals and second data signals based on the second image information to the pixels from the respective ones of the scan lines during a second emission period, wherein the first and second data signals include data information corresponding to respective subfields in a unit time.

The first image information may include left-eye image information of a stereoscopic image and the second image information may include right-eye image information of the stereoscopic image.

The respective subfields in the unit time may be different from each other.

The first and the second pre-data signals may be the same as subfield data at ends of the first and the second emission periods, respectively.

The first and the second pre-data signals may assign parts of weights at a beginning of the first and the second emission periods, respectively, to satisfy a weight of a corresponding subfield in one frame.

The subfield data subsequent to the first and the second pre-data signals may be provided to the pixels before frame-starting subfield data are provided during the first and second emission periods.

The first and the second dummy-data signals may be the same as subfield data of different scan lines started at selection times before the subfields corresponding to the first and the second pre-data signals are started in the first and the second emission periods.

The first and the second dummy-data signals may be applied at least one selection time before the first and the second pre-data signals are applied.

The first and the second scan signals may be sequentially applied during the first and the second non-emission periods.

The first and the second scan signals may not be applied to the pixels when the first and the second dummy-data signals are applied.

According to aspects of embodiments of the present invention, the organic light emitting display device and the driving method thereof may exhibit improvement in non-uniform luminance caused by poor charging characteristics of large-sized display panels in the same gray-scale condition by employing a concurrent (e.g., simultaneous) emission method.

The foregoing is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The above and other features and aspects of the present invention will be more clearly understood from the following detailed description taken in conjunction with the accompanying drawings, in which.

DETAILED DESCRIPTION

Figure 1:
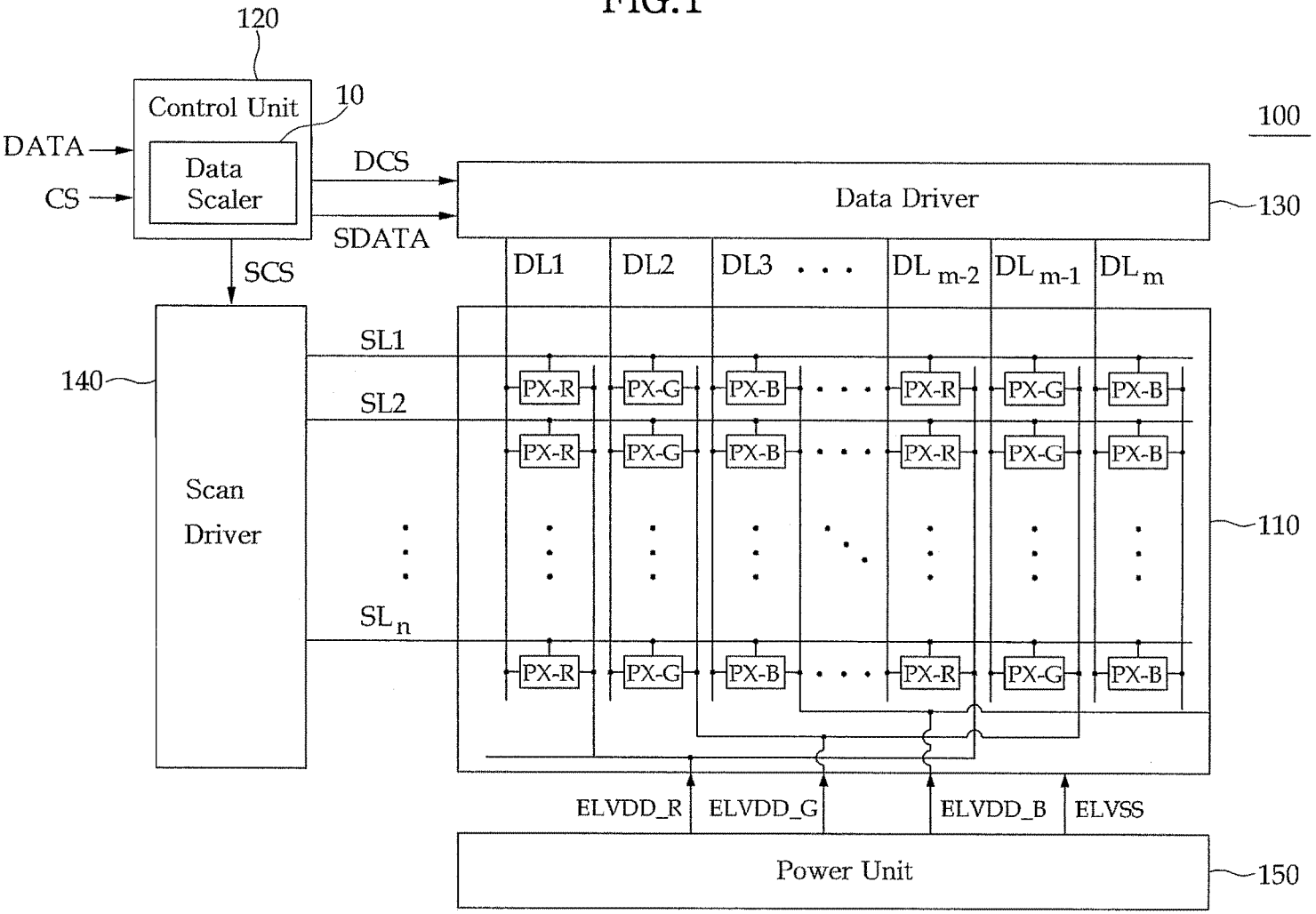
FIG. 1 is a schematic plan view showing a display device according to some embodiments of the present invention.

Hereinafter, aspects of embodiments of the present invention will be described in more detail with reference to the accompanying drawings.

Although the present invention can be modified in various manners and have several embodiments, example embodiments are illustrated in the accompanying drawings and are described in the specification. However, the scope of the embodiments of the present invention is not limited to the specific embodiments and should be construed as including all the changes, equivalents, and substitutions included in the spirit and scope of the present invention.

It will be understood that, although the terms "first," "second," "third," and the like may be used herein to describe various elements, these elements should not be limited by these terms. These terms are only used to distinguish one element from another element. Thus, "a first element" discussed below could be termed "a second element" or "a third element," and "a second element" and "a third element" can be termed likewise without departing from the teachings herein.

Some of the parts which are not associated with the description may not be provided in order to specifically describe embodiments of the present invention, and like reference numerals refer to like elements throughout the specification.

FIG. 1 is a schematic plan view showing a display device according to an embodiment of the present invention.

Referring to FIG. 1, an OLED 100 includes a display panel 110 including a plurality of pixels, a data driver 130 applying data signals to the pixel circuit over data lines DL1~$DL_m$, a scan driver 140 applying scan signals to the pixel circuit over scan lines SL1~$SL_n$, a power unit 150 applying a driving power to the organic light emitting diodes OLEDs (shown, e.g., in FIG. 2) of the pixels, and a control unit 120 controlling the data driver 130, the scan driver 140, and the power unit 150.

Further, the display device 100 may further include the power unit 150 on the display panel 110 in order to provide a driving power ELVDD (e.g., ELVDD_R, ELVDD_G, and ELVDD_B) and power ground ELVSS.

The display panel 110 includes a plurality of scan lines SL1~SLn extending in a row direction for applying scan signals, a plurality of data lines DL1~$DL_m$ extending in a column direction, and a plurality of pixels PX arranged in a matrix pattern and coupled to the scan lines SL1~$SL_n$ and the data lines DL1~$DL_m$. The driving power ELVDD (e.g., ELVDD_R, ELVDD_G, and ELVDD_B) and the power ground ELVSS are supplied to the plurality of pixels PX from the power unit 150, and further the scan signals and the data signals are provided to the pixels PX (e.g., PX-R, PX-G, and PX-B) over scan lines SL1~SLn and data lines DL1~DLm, respectively.

FIG. 1 illustrates a single bank structure where the driving power ELVDD is applied to only one side of the panel. However, in a case where a large-sized panel is used, voltage drops may occur depending on the length of the power lines. Therefore, a dual bank structure may be used, where panels are divided into two parts and the power is supplied to both sides of the panel.

Figure 2:
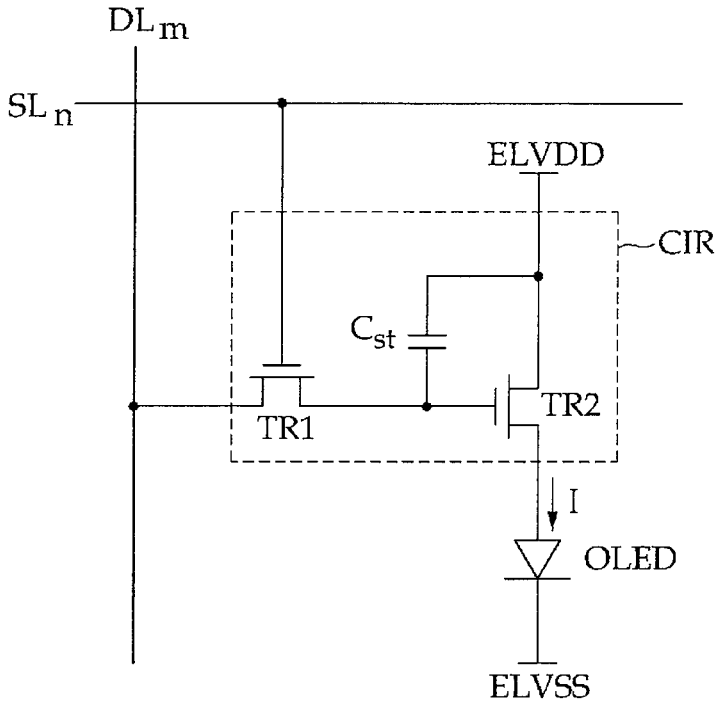
FIG. 2 is a circuit diagram showing a pixel circuit of the display device according to some embodiments of the present invention.

Meanwhile, each of the pixels PX provided in the display panel 110 includes an organic light emitting diode OLED (shown, e.g., in FIG. 2). In a case where the driving power ELVDD and the power ground ELVSS are supplied, current flows through the OLED, and thus light is emitted. However, embodiments of the present invention are not limited thereto. Thus, the display panel 110 may include other types of panels including a self-light emitting element.

The control unit 120 controls the data driver 130, the scan driver 140, and the power unit 150. The control unit 120 is configured to generate signals for controlling the data driver 130, the scan driver 140, and the power unit 150 based on image signals DATA and control signals CS provided from an external source, and transmits the generated signals to the data driver 130, the scan driver 140, and the power unit 150.

For example, the control signals CS may be timing signals such as vertical synchronization signals Vsync and horizontal synchronization signals Hsync, clock signals CLK, and data enable signals DE, while the image signals DATA may be digital signals expressing gray-levels of light emitted from the pixels PX.

The data driver 130 receives data control signals DCS and scaled image signals from the control unit 120, and supplies data signals corresponding to the scaled image signals to the pixels PX over data lines DL1~$DL_m$ in response to the data control signals DCS.

The scan driver 140 receives scan control signals SCS from the control unit 120, and generates the scan signals. Further, the scan driver 140 may transmit the generated scan signals to the pixels PX over the scan lines SL1~$SL_n$. Rows of the pixels PX are sequentially selected on a row-by-row basis in response to the scan signals, and the data signals may be provided thereto.

The power unit 150 generates the driving power ELVDD and the power ground ELVSS and applies the power to the display panel 110. The driving power ELVDD and the power ground ELVSS are applied to the plurality of pixels PX of the display panel 110, such that the pixels PX can emit light. An amount of current flowing through the pixels PX during an emission period may be determined in accordance with the voltage value of the driving power ELVDD and the power ground ELVSS.

FIG. 2 is a circuit diagram showing a pixel circuit of a display device according to embodiments of the present invention. For example, FIG. 2 illustrates a pixel circuit of an OLED. For ease of description, a pixel circuit coupled to the data line $DL_m$ and the scan line $SL_n$ is illustrated. Each pixel may have a corresponding pixel circuit with a similar structure or configuration.

Referring to FIG. 2, the pixels PX may include the organic light emitting diode OLED and the pixel circuit CIR supplying current to the organic light emitting diode OLED. Meanwhile, the pixel circuit CIR may include a plurality of transistors TR1 and TR2, and a capacitor Cst. The plurality of transistors TR1 and TR2 may be thin film transistors TFT. In FIG. 2, the pixel circuit CIR is illustrated as having two transistors TR1 and TR2 and one capacitor Cst. However, embodiments of the present invention are not limited thereto. Thus, the pixel circuit CIR may have various configurations to supply current to the organic light emitting diode in accordance with the data signals.

An anode electrode of the organic light emitting diode OLED is coupled to the pixel circuit CIR, and a cathode electrode is coupled to the power ground ELVSS. Such organic light emitting diodes OLEDs generate light corresponding to the current supplied from the pixel circuit CIR.

When the scan signal is applied to the scan line $SL_n$, the pixel circuit CIR is supplied with the data signal from the data line $DL_m$. In a case where the scan signal is supplied to the scan line $SL_n$, the first transistor TR1 is turned on. In a case where the data signal is applied to a gate electrode of the second transistor TR2 over the data line $DL_m$, the data signal controls turn-on/turn-off of the second transistor TR2. In a case where the second transistor TR2 is turned on in response to the data signal, the driving power ELVDD is applied to the anode electrode of the organic light emitting diode OLED, and thus current I flows through the organic light emitting diode OLED. Accordingly, the organic light emitting diode OLED emits light. In this case, an amount of the current I may vary depending on the voltage applied to both end portions of the organic light emitting diode OLED, that is, depending on voltage values of the driving power ELVDD and the power ground ELVSS. In a case where the second transistor TR2 is turned off, the anode electrode of the OLED floats, such that light becomes extinct in the organic light emitting diode OLED. Meanwhile, the capacitor Cst stores voltage corresponding to the voltage difference between the driving power ELVDD and the applied data signal, such that the second transistor TR2 can maintain a state of turn-on or turn-off, although the first transistor TR1 is turned off and the data signals are not applied.

Figure 3:
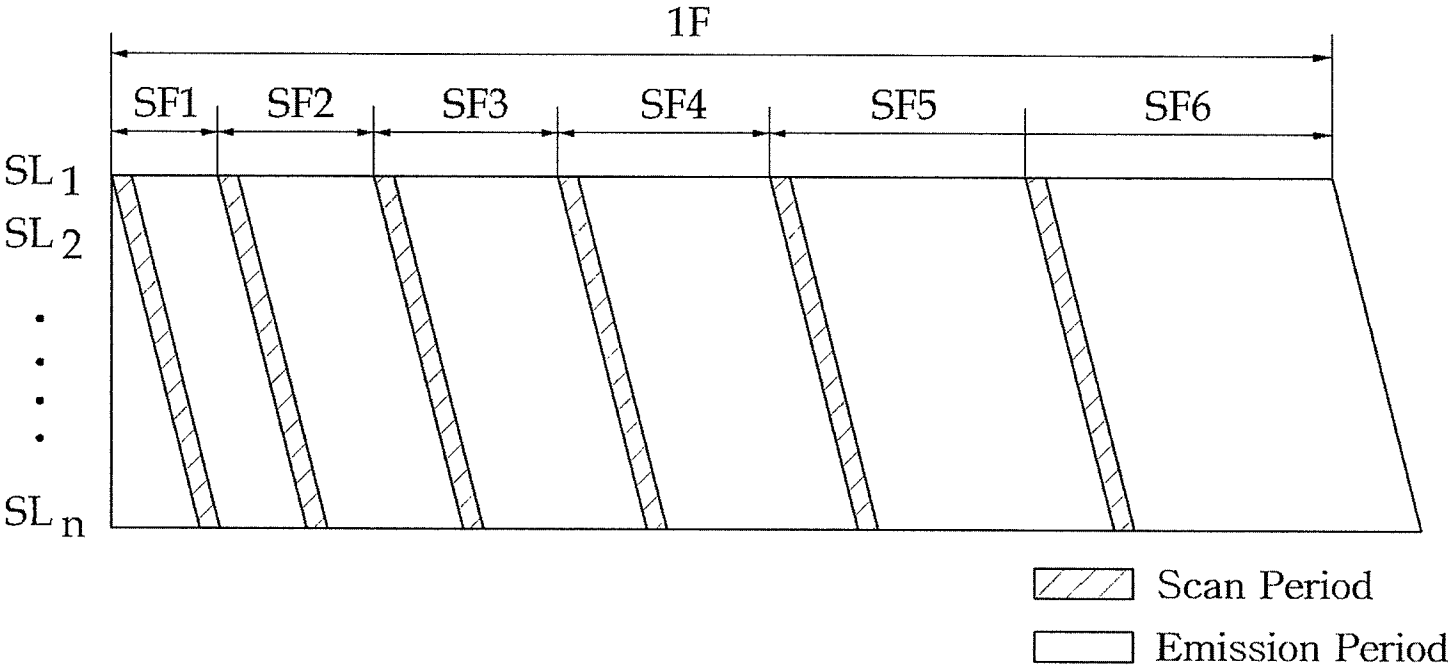
FIG. 3 is a conceptual image for explaining a digital driving method of an OLED.

FIG. 3 is a conceptual image for explaining a digital driving method of an OLED.

When the digital driving method is used, the gate electrode of the second transistor TR2 may be supplied with voltage only having two states of on and off. Accordingly, gray-scale may be expressed by adjusting emitting time of the pixels PX, which is achieved by combining subfields described below, instead of adjusting the amount of light emitted from the pixels.

A subfield is defined as a concept dividing a reference-image frame into time units having different emitting-time weights. Gray-scale can be expressed by selective combinations of subfields, each having a different light-emitting time. A method of expressing gray-scale by adjusting the length of emitting time may be better understood by considering the binary representation of decimal numbers.

For example, in order to determine a subfield weight, it may be assumed that one frame is divided into six subfields and the respective subfield has a two times longer emitting time compared to the previous subfield. Each of the six subfields represents each digit position of a binary number and the on-off information in order to express luminance, thereby representing gray level. For example, the first subfield SF1 has a weight of $2^0$, and the second subfield SF2 has a weight of $2^1$, such that the weights have a growing sequence of $2^n$ (n=0,1,2,3,4,5).

As a result, the display device may express $2^6$=64 gray levels of luminance by differently combining on and off states by using the subfield data. If arranged in descending order of the length of emitting time, that is, arranged from the one having a highest luminance weight, the subfields make an order of SF6, SF5, SF4, SF3, SF2, SF1.

The gray level of the pixels can be expressed as follows: an on-state data voltage of a subfield (e.g., 5V) is expressed as '1' in binary form, while an off-state data voltage of a subfield (e.g., 0V) is expressed as '0' in binary form. For example, a gray level of 63 can be expressed as '111111' in binary form, and thus all subfields in one frame therefore have on states, exhibiting a state of "SF6, SF5, SF4, SF3, SF2, SF1"="On, On, On, On, On, On." This means that the corresponding pixel is supplied with on-state data for all subfields in the frame and emits light accordingly. Further, a gray level of 6 can be expressed as '000110' in binary form. In this case, the subfields 2 and 3 have on states, exhibiting a state of "SF6, SF5, SF4, SF3, SF2, SF1"="Off, Off, Off, On, On, Off" such that, the subfields 2 and 3 of the pixel can emit light and express the gray level of 6. Accordingly, the emitting time of the pixels PX in one frame period can be adjusted to express gray-scale.

Figure 4:
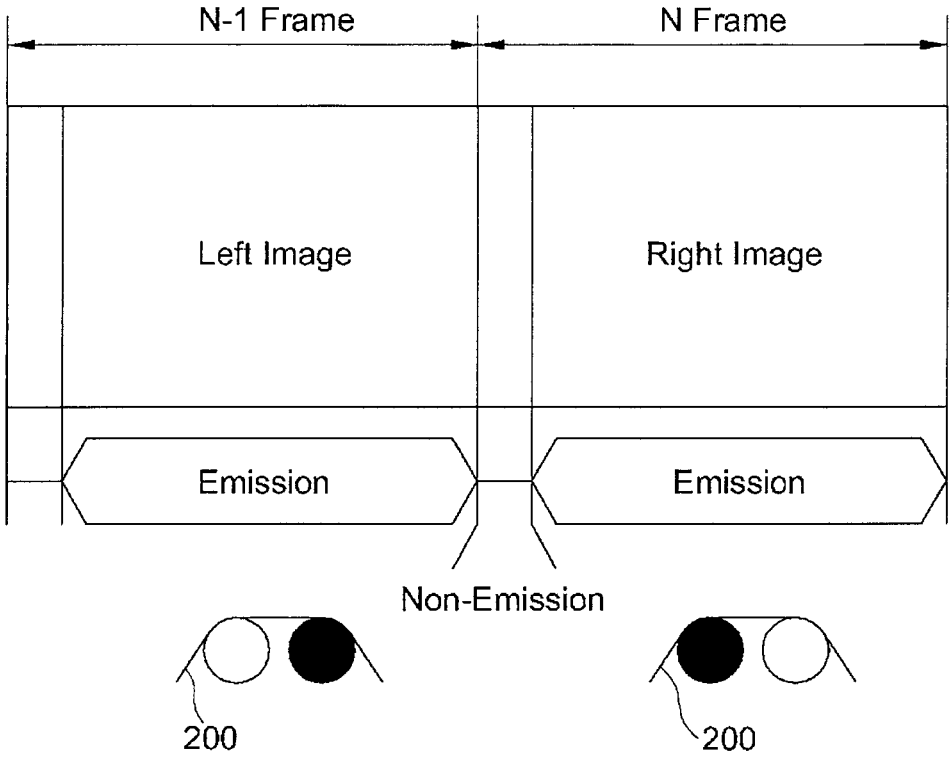
FIG. 4 is a block diagram for explaining a stereoscopic image display according to some embodiments of the present invention.

FIG. 4 is a block diagram for explaining a stereoscopic image display according to embodiments of the present invention;

In FIG. 4, x-axis represents time, and y-axis represents a vertical position of a display unit. The display unit 110 alternately provides a left image and a right image on a frame-by-frame basis in order to provide a 3D stereoscopic image. Further, shutter glasses 200 are synchronized to a frame frequency in order to open and close shutters for left and right eyes.

According to embodiments of the present invention, in a case where the display panel displays a left image in a left image frame N-1 Frame, the shutter glasses 200 synchronized with the display panel are controlled to open the left-eye shutter and close the right-eye shutter. That is, light transmission through the left-eye shutter is increased to allow light to pass through and light transmission through the right-eye shutter is attenuated to block light. Accordingly, a user wearing the shutter glasses can view the left image through the left-eye shutter, which is open in an N-1 Frame period.

On the other hand, in a case where the display panel displays a right image in a right image frame N Frame, the shutter glasses 200 are controlled to open the right-eye shutter and close the left-eye shutter. The user can view the right image through the right-eye shutter, which is open in an N Frame period.

Non-emission periods are located between emission periods of the frame. During a non-emission period, all the pixels of the display device do not emit light, which is achieved when the power unit 150 controls the driving voltage ELVDD and the ground voltage ELVSS to maintain the voltage difference between the two voltages at 0 volts.

During the non-emission period, emitting information is provided to the pixels over the scan lines and the data lines and stored in the storage capacitor Cst of the respective pixels.

Figure 5:
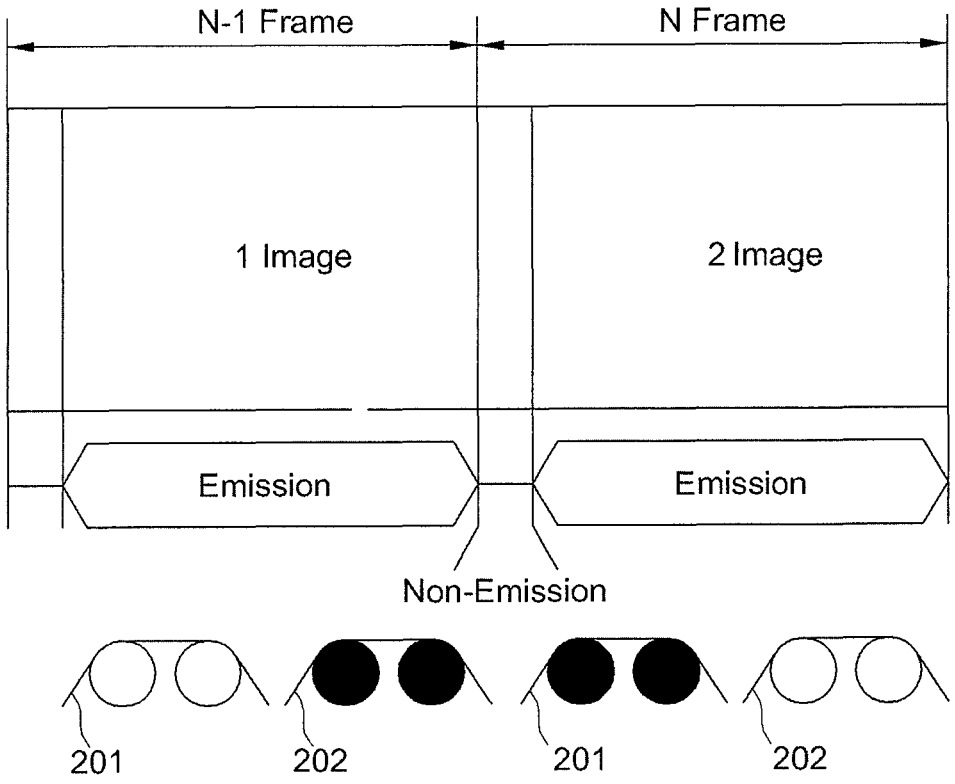
FIG. 5 is a block diagram for explaining a dual image display according to some embodiments of the present invention.

FIG. 5 is a block diagram for explaining a dual image display according to an embodiment of the present invention.

Referring to FIG. 5, the display unit 110 alternately provides a first image and a second image on a frame-by-frame basis in order to provide a 2D dual image. The first image 1 Image and the second image 2 Image are based on different information (e.g., separate data signals) and may be provided, for example, from different broadcasting channels, or different video sources.

The 2D dual image displaying method is used for providing different images to different users with one display device. The different users use different shutter glasses 201 and 202 synchronized to different frequencies.

The display panel displays the first image 1 Image in a first image frame N-1 Frame. In a case where the first image 1 Image is displayed, the first shutter glasses 201 synchronized with the first image 1 Image have both of the right-eye and left-eye shutters open. On the contrary, the second shutter glasses 202 synchronized with the second image 2 Image have both of the right-eye and left-eye shutters closed.

The display panel displays the second image data Image 2 in a second image frame N Frame. In this case, the second shutter glasses 202 synchronized with the second image 2 Image have both of the right-eye and left-eye shutters open. On the contrary, the first shutter glasses 201 for the first image 1 Image have both of the right-eye and left-eye shutters closed.

In other words, the user wearing the first shutter glasses views only the first image 1 Image, while the user wearing the second shutter glasses views only the second image 2 Image. As a result, one display panel can provide two different images.

Figure 6:
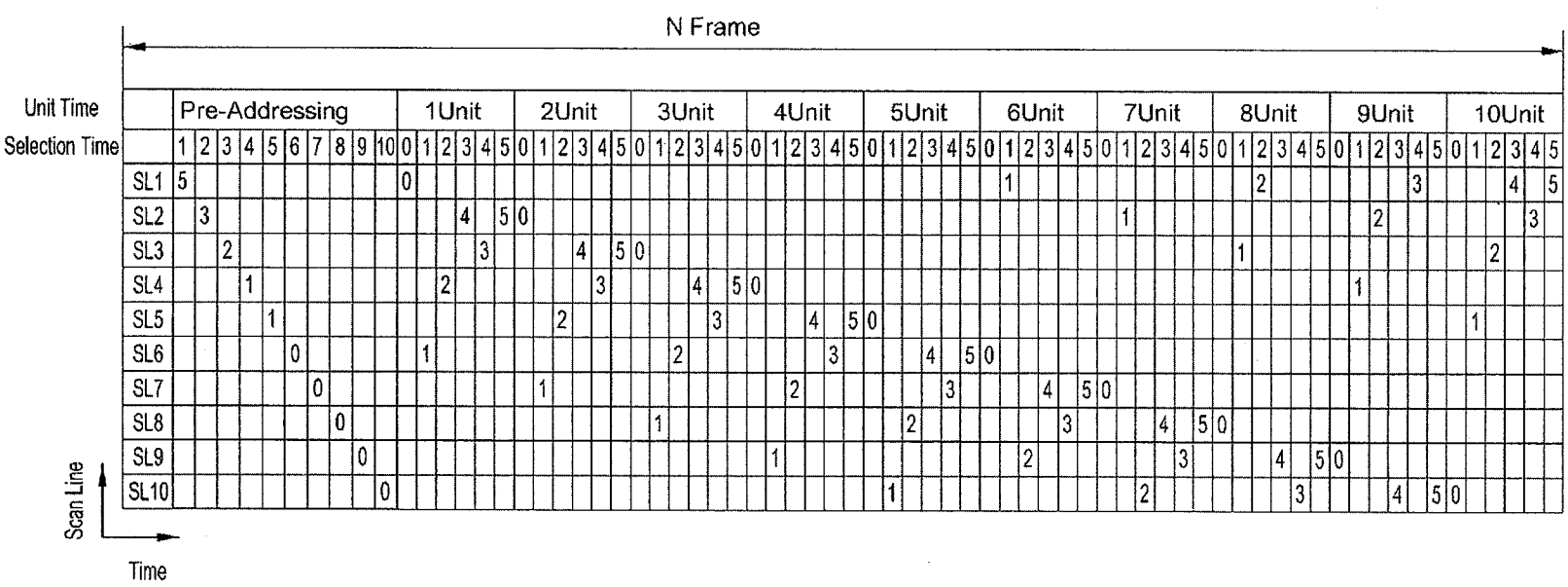
FIG. 6 is a timing diagram for explaining a driving mechanism of an image frame according to some embodiments of the present invention.

FIG. 6 is a timing diagram for explaining a driving mechanism of an image frame according to an embodiment of the present invention.

Hereinafter, for ease of description, it is assumed that the display panel 110 has only ten scan lines (SL1 through SL10). According to embodiments of the invention, however, the number of scan lines may vary according to the design of the display panel 110.

In FIG. 6, x-axis represents time, and y-axis represents the scan lines SL.

Referring to FIG. 6, when a concurrent (e.g., simultaneous) emission method is used, a frame is divided into temporally sequential unit times, and data information of subfields assigned to the respective frame are written in pixels of different scan lines in a respective unit time.

FIG. 6 illustrates that six subfields 0 through 5 are used in order from the subfield having the highest weight.

The unit time is a concept for representing driving times composing an image frame N Frame. The frame is composed of emission periods and non-emission periods, and the number of unit times in the emission period may be the same as the number of scan lines $SL_n$ of the display panel 110.

In addition, respective unit times may be divided into selection times the number of which is the same as subfields.

The selection time is the smallest time within which scan signals can be applied to scan lines or data signals can be applied to the respective pixel. The scan signal is applied to a scan line and the data voltage is applied to the respective pixel via the data lines at respective selection times. The data signals applied to the data lines include data information corresponding to respective subfields in a unit time. Further, the subfields in the unit time are different from each other. The data information applied to the respective pixels corresponds to on-off states of the respective subfields, and the corresponding subfield number of the applied data is written at intersections of the scan lines and the selection times.

The pixels of the scan lines maintain the emission state or non-emission state depending on subfield data written in advance before the respective subfields are started in response to the applied scan signals.

According to some embodiments of the present invention, the emission period has 10 unit times, the number of which is the same as the number of scan lines of the panel, and the respective unit time is divided into 6 selection times, the number of which is the same as the number of the subfields. Therefore, the emission time has total 60 selection times.

A weight of the subfield is determined by the selection times from where the subfield is started to where the subfield is ended before the next subfield is started, and thus the weight of the respective subfield is the sum of the corresponding selection times.

For example, in a case where the emission period is composed of 60 selection times, the subfields 0 through 5 have a weight of 60. Therefore, the subfields 0 through 5 have selection times corresponding to the weight of "31", "13", "8", "5", "2", "1," respectively.

According to embodiments of the present invention, in a case where the subfield is assigned based on the unit time, the zeroth subfield of the first scan line is located at the first unit time and the zeroth subfields of the other scan lines except the first scan line may be located at the second through the tenth unit times. The scan lines except the first scan line assign the subfields to the selection times in the emission period before the zeroth subfields are started, such that all the scan lines can have the same subfield weight in total.

According to embodiments of the present invention, in order to assign the subfields to the scan lines, a subfield group assigned based on the unit time may have a configuration where the subfield group is shifted with a predetermined scan line interval in an adjacent unit time.

Referring to FIG. 6, pre-data, including on-off information of the subfields, are written in the pixels in the non-emission period. Provided that the pre-data is written, the pixels of all the scan lines emit or do not emit light in accordance with the on-off information of subfields from the beginning of the emission period.

In a case where the pre-data is written in the pixels, a part of weight can be assigned from the beginning of the emission period, such that the entire weight of the corresponding subfield can be assigned in one frame. For example, a driving mechanism of the second scan line SL2 will be described from the beginning of the zeroth subfield in the emission period (the first selection time of the second unit time), on condition that all the pixels in the second scan line SL2 emits light in all subfields.

The pixels of the second scan line SL2 are supplied with data voltages for the zeroth through the second subfields, and then supplied with a data voltage for two selection times from a starting point of the third subfield (that is, the fourth selection time of the tenth unit time) to the fifth selection time of the tenth unit time (weight 2) in the emission period.

In order to express a desired gray level, the pixels of the second scan line SL2 further receive 3 more weight of the third subfield, weight 2 of the fourth subfield, and weight 1 of the fifth subfield. However, the second scan line SL2 may not assign a part of weight of the third subfield and the entire weight of the fourth and the fifth subfields after the beginning of the third subfield.

Therefore, according to embodiments of the present invention, the driving method assigns weight 3 of the third subfield, weight 2 of the fourth subfield, and weight 1 of the fifth subfield to the selection times from the beginning of the emission period to the beginning of the zeroth subfield.

Subfield data subsequent to the pre-data signals are provided in the emission period before the zeroth subfield is started, such that the entire subfields can be assigned in one frame.

In addition, according to embodiments of the present invention, the driving method provides the subfield information required at the beginning of the emission period to the pixels in the non-emission period in advance, such that the light can be emitted from the beginning of the emission period.

In the non-emission period, the scan signals are sequentially applied to the scan lines SL1 through SL10 at the respective selection time, and the subfield data, which are the same as the subfield data at the endpoint of the emission period, are provided to the pixels in synchronization with the scan signals.

Accordingly, the subfield data at the endpoint of the emission period can be applied to the pixels of the scan lines, respectively, in advance when the non-emission period is ended and the emission period is started, such that the entire weight of the corresponding subfield can be assigned in one frame.

Hereinafter, a timing sequence of the scan signals and the subfield data applied to the pixels of the second scan line SL2 will be described in more detail.

The pixels of the second scan line SL2 are supplied with a scan signal and the subfield data, which is the same as the third subfield data at the endpoint of the emission period, as a pre-data signal at the second selection time of the non-emission period.

The pre-data signal is stored in the storage capacitors Cst of the pixels of the second scan line SL2 in the non-emission period, and the pixels of the second scan line SL2 emit light (or do not emit light) in accordance with the voltage stored in the storage capacitors Cst from the first unit time at the beginning of the emission period.

In addition, the pixels of the second scan line SL2 are further supplied with the data of the fourth and the fifth subfields sequentially in the emission period before the zeroth subfield is started.

In other words, the pre-data is written in the non-emission period, such that the same subfield weight can be assigned to the pixels of the scan lines in the emission period, respectively, and the display panel is thereby capable of displaying a desired image, although driven in a non-sequential scan mode.

However, in a case where the same subfield data is divided and provided to the pixels in the emission period and in the non-emission period, respectively, data voltage waveforms may become different between the emission period and the non-emission period, although the same subfield data is applied, thereby resulting in luminance non-uniformity of the display panel.

An amount of light emitted from the organic electroluminescence display device depends on a gate voltage applied to the second transistor, such that a small difference in the data voltage applied to the pixels may produce luminance non-uniformity. The luminance non-uniformity of the display panel caused by a change in data voltage waveform is called pre-charge luminance non-uniformity The pre-charge luminance non-uniformity is often produced in large-area OLED devices employing a high-speed scanning method with scan signals having a frequency of 1 us or less.

Figure 7:
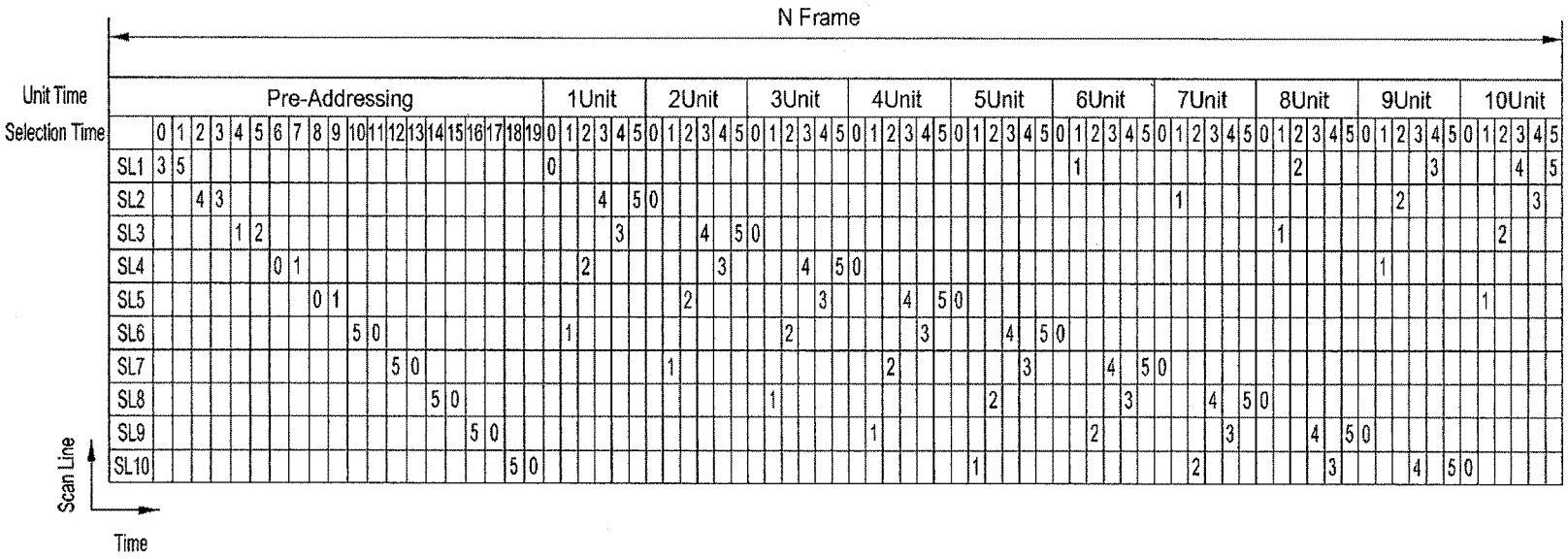
FIG. 7 is a timing diagram for explaining a driving mechanism of an image frame according to some embodiments of the present invention.

FIG. 7 is a timing diagram for explaining a driving mechanism of an image frame according to some embodiments of the present invention.

Figure 8:
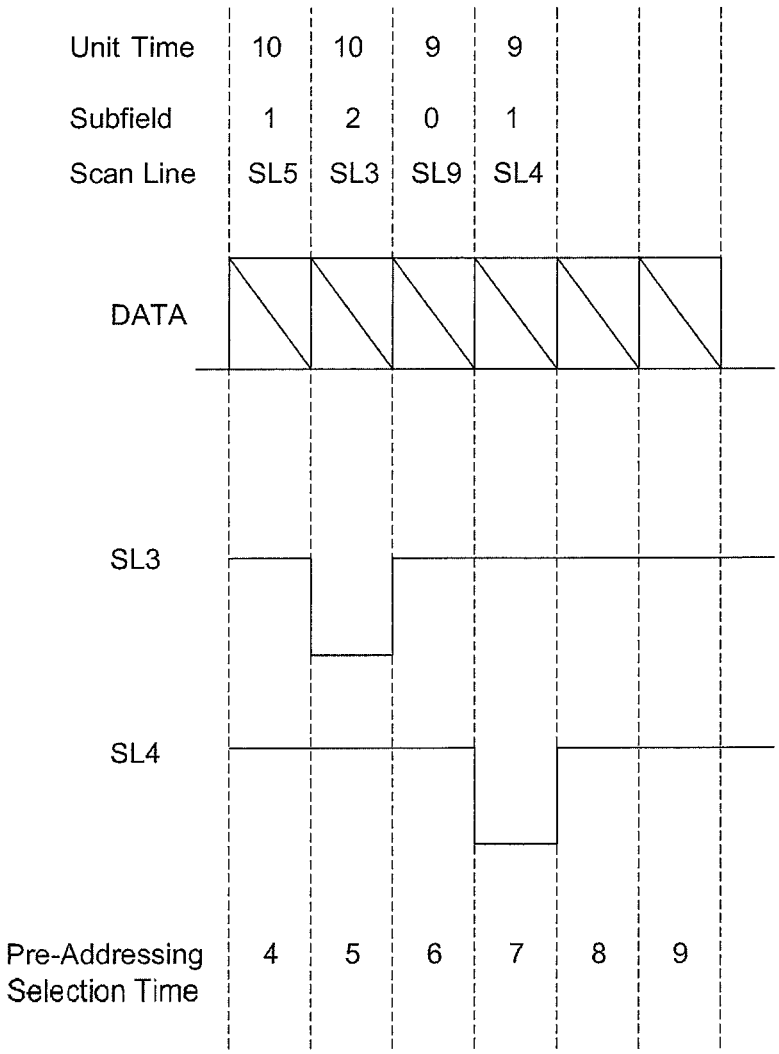
FIG. 8 is a waveform diagram for explaining data signals and scan signals of an image frame in a non-emission period according to some embodiments of the present invention.

FIG. 8 is a waveform diagram for explaining data signals and scan signals of an image frame in a non-emission period according to some embodiments of the present invention.

Hereinafter, a method of applying substantially the same waveform in an emission period and in a non-emission period by applying dummy-data signals in the non-emission period before the pre-data signals are applied will be described with reference to FIGS. 7 and 8.

The dummy-data signal is the same signal as the subfield data of a different scan line started at a selection time right before the subfield corresponding to the pre-data signal is started in the emission period, and is applied at least one selection time before the pre-data signal. Accordingly, the driving condition of the pre-data applied can be made the same as the condition of the data applied in the emission period.

Hereinafter, waveforms of the third scan line SL3 and the fourth scan line SL4 in the non-emission period will be described with reference to FIGS. 7 and 8.

As illustrated in FIG. 7, pre-data of the third scan line SL3 (the second subfield data) is the same signal as second subfield data applied at the second selection time of the tenth unit time.

Further, as illustrated in FIG. 8, dummy-data of the third scan line SL3 (the first subfield data) is the same signal as subfield data of the fifth scan line SL5 (the first subfield data) started at a selection time right before subfield corresponding to the pre-data signal of the third scan line SL3 in the emission period, and is applied for at least one selection time.

In addition, the pre-data signals play a role in assigning parts of weights at the beginning of the emission period so as to satisfy the weight of the corresponding subfield in one frame.

Meanwhile, as illustrated in FIG. 8, the scan signals may not be applied to the pixels when the dummy-data signals are applied. That is because the dummy-data signals are applied in order to match the waveform of the pre-data signals applied in the non-emission period and the waveform of the subfield data applied at the endpoint of the emission period.

Figure 9:
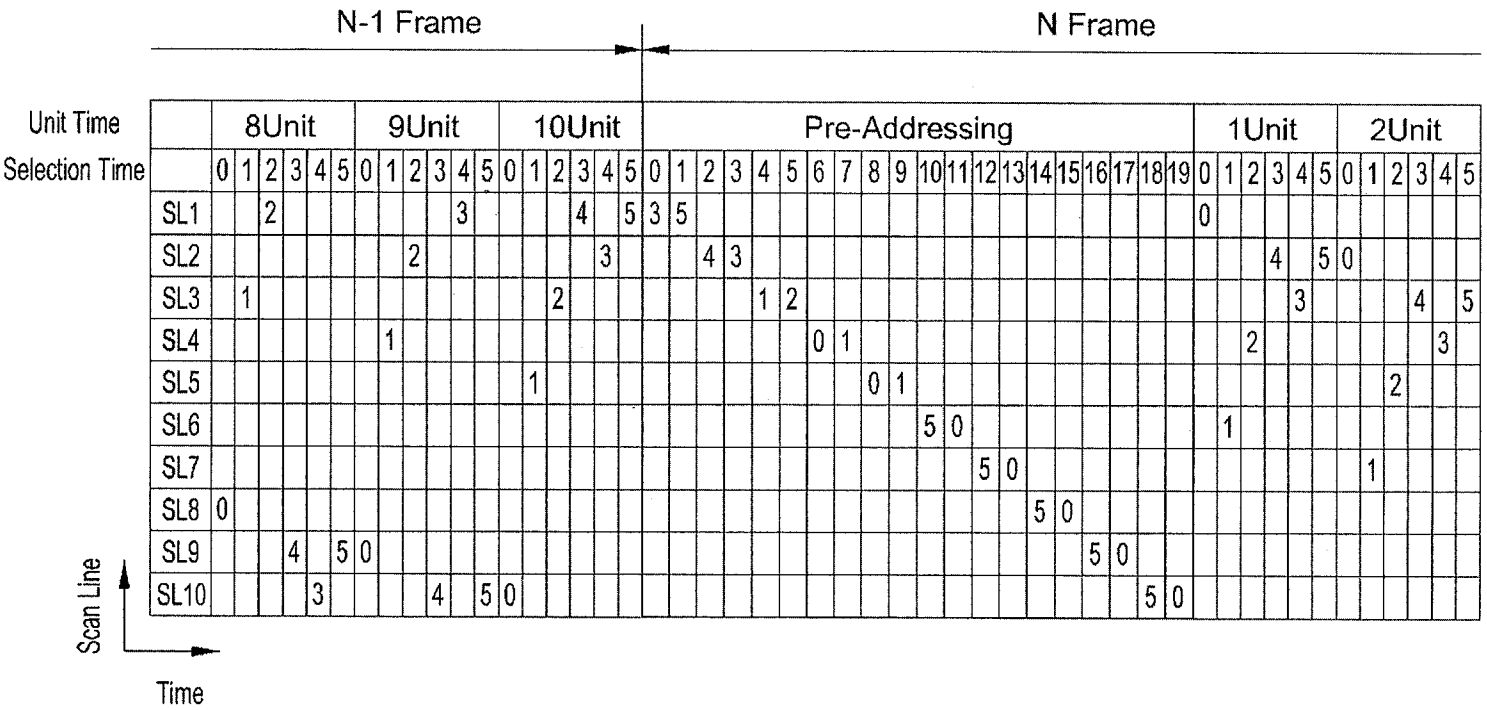
FIG. 9 is a timing diagram illustrating a relationship between a previous frame N-1 Frame and a current frame N-Frame.

FIG. 9 is a timing diagram illustrating a relationship between a previous frame N-1 Frame and a current frame N Frame.

Referring to FIG. 9, a subfield configuration of the previous frame N-1 Frame is the same as a subfield configuration of the current frame N Frame. Pre-data information applied in a non-emission period of the current frame N Frame is based on data information to be applied in the current frame N Frame.

Scanning is non-sequentially carried out in an emission period of the previous frame N-1 Frame, whereas the scanning is sequentially carried out in the non-emission period of the current frame N Frame.

The display devices according to an embodiment of the present invention may be applied to the 3D display device or the dual 2D display device described in FIGS. 4 and 5.

In a case where the display device according to an embodiment of the present invention is applied to the 3D display device or the dual 2D display device, first image information and second image information different from each other are input from an external source.

The first image information applied from the external source is displayed on a first frame, and the second image information different from the first image information is displayed on a second frame subsequent to the first frame.

As illustrated in an embodiment of the present invention, the first frame includes the emission period and the non-emission period, and the entire first image information can be displayed during the emission period by applying the dummy-data signals and the pre-data signals during the non-emission period.

The pre-data signal has the same data as the subfield data at the endpoint of the emission period in the corresponding frame.

The dummy-data signal has the same data as the subfield data of a different scan line started at a selection time right before the subfield corresponding to the pre-data signal is started in the emission period.

The second frame has the same frame configuration as the first frame.

A method of synchronizing shutter glasses to the emission period of the respective frame is similar to the description in FIGS. 4 and 5.

From the foregoing, it will be appreciated that various embodiments in accordance with the present disclosure have been described herein for purposes of illustration, and that various modifications may be made without departing from the scope and spirit of the present teachings. Accordingly, the various embodiments disclosed herein are illustrative and are not intended to be limiting of the true scope and spirit of the present invention. Thus, while the present invention has been described in connection with certain example embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A method of driving an organic light emitting display device, the method comprising:

applying a respective one of a plurality of dummy-data signals, a respective one of a plurality of pre-data signals, and a respective one of a plurality of scan signals to each pixel of a plurality of pixels of the organic light emitting display device, respectively, from respective ones of scan lines and data lines of the organic light emitting display device during a non-emission period; and non-sequentially applying the scan signals and data signals to the pixels from the respective ones of the scan lines and the data lines during an emission period, wherein the data signals comprise data information corresponding to respective subfields in a unit time, wherein the pre-data signals are the same as subfield data at an end of the emission period, wherein each of the dummy-data signals corresponds to one of the pre-data signals, wherein each of the dummy-data signals is the same as subfield data of a different one of the scan lines, the different one of the scan lines being started, during the emission period, at a selection time before the subfield which corresponds to the corresponding one of the pre-data signals, and wherein the dummy-data signals are each applied at least one selection time before the corresponding one of the pre-data signals is applied.

2. The method of claim 1, wherein the respective subfields in the unit time are different from each other.

3. The method of claim 2, wherein the pre-data signals assign parts of weights at a beginning of the emission period to satisfy a weight of a corresponding subfield in one frame.

4. The method of claim 3, wherein the subfield data comprises first subfield data through $i^{th}$ subfield data, where i is the number of subfields in the unit time, and wherein the subfield data, which are subsequent to the subfield data corresponding to the pre-data signals, are provided to the pixels before the first subfield data are provided to the pixels during the emission period.

5. The method of claim 1, wherein the scan signals are not applied to the pixels of the scan lines when the dummy-data signals are applied.

6. The method of claim 5, wherein the scan signals are sequentially applied during the non-emission period.

7. The method of claim 1, wherein the scan signals are applied to the pixels when the pre-data signals are provided.

8. A method of driving an organic light emitting display device, the method comprising:

receiving first image information;

receiving second image information different from the first image information;

applying a respective one of a plurality of first dummy-data signals, a respective one of a plurality of first pre-data signals, and a respective one of a plurality of first scan signals based on the first image information to each pixel of a plurality of pixels of the organic light emitting display device, respectively, from respective ones of scan lines of the organic light emitting display device and data lines of the organic light emitting display device during a first non-emission period;

non-sequentially applying the first scan signals and first data signals based on the first image information to the pixels from the respective ones of the scan lines and the data lines during a first emission period;

applying a respective one of a plurality of second dummy-data signals, a respective one of a plurality of second pre-data signals, and a respective one of a plurality of second scan signals based on the second image information to each pixel of the plurality of the pixels from the respective ones of the scan lines and the data lines during a second non-emission period; and non-sequentially applying the second scan signals and second data signals based on the second image information to the pixels from the respective ones of the scan lines during a second emission period, wherein the first and second data signals comprise data information corresponding to respective subfields in a unit time, wherein the first and the second pre-data signals are the same as subfield data at ends of the first and the second emission periods, respectively, wherein each of the first dummy-data signals corresponds to one of the first pre-data signals, wherein each of the first dummy-data signals is the same as subfield data of a different one of the scan lines, the different one of the scan lines being started at a selection time before the subfield which corresponds to the corresponding one of the first pre-data signals, wherein each of the second dummy-data signals corresponds to one of the second pre-data signals, and wherein each of the second dummy-data signals is the same as subfield data of a different one of the scan lines, the different one of the scan lines being started at a selection time before the subfield which corresponds to the corresponding one of the second pre-data signals.

9. The method of claim 8, wherein the first image information comprises left-eye image information of a stereoscopic image and the second image information comprises right-eye image information of the stereoscopic image.

10. The method of claim 8, wherein the respective subfields in the unit time are different from each other.

11. The method of claim 10, wherein the first and the second pre-data signals assign parts of weights at a beginning of the first and the second emission periods, respectively, to satisfy a weight of a corresponding subfield in one frame.

12. The method of claim 11, wherein the subfield data comprises first subfield data through $i^{th}$ subfield data, where i is the number of subfields in the unit time, and wherein the subfield data, which are subsequent to the subfield data corresponding to the first and the second pre-data signals, are provided to the pixels before the first subfield data are provided to the pixels during the first and second emission periods.

13. The method of claim 10, wherein the first dummy-data signals are applied at least one selection time before the corresponding one of the first pre-data signals is applied, wherein the second dummy-data signals are applied at least one selection time before the corresponding one of the second pre-data signals is applied.

14. The method of claim 13, wherein the first and the second scan signals are sequentially applied during the first and the second non-emission periods.

15. The method of claim 10, wherein the first and the second scan signals are not applied to the pixels when the first and the second dummy-data signals are applied.

* * * * *